US010480913B1

(12) United States Patent
Schabel et al.

(10) Patent No.: US 10,480,913 B1
(45) Date of Patent: Nov. 19, 2019

(54) BLOOD DRAINING ARROW

(71) Applicants: Russell Schabel, Newton Falls, OH (US); Timothy J. Morrison, Newton Falls, OH (US)

(72) Inventors: Russell Schabel, Newton Falls, OH (US); Timothy J. Morrison, Newton Falls, OH (US)

( * ) Notice: Subject to any disclaimer, the term of this patent is extended or adjusted under 35 U.S.C. 154(b) by 0 days.

(21) Appl. No.: 16/049,887

(22) Filed: Jul. 31, 2018

(51) Int. Cl.
*F42B 6/04* (2006.01)
*F42B 12/36* (2006.01)
*F42B 6/06* (2006.01)

(52) U.S. Cl.
CPC ..... *F42B 6/04* (2013.01); *F42B 6/06* (2013.01); *F42B 12/362* (2013.01)

(58) Field of Classification Search
CPC ..... F42B 6/04; F42B 12/362
USPC ..... 473/578, 581
See application file for complete search history.

(56) References Cited

U.S. PATENT DOCUMENTS 2,554,012 A * 5/1951 Cohen ..... F42B 6/04 473/581
3,617,060 A * 11/1971 Iezzi ..... F42B 6/04 473/581
4,050,696 A 9/1977 Troncosco, Jr.
4,212,463 A * 7/1980 Repinski ..... F42B 6/04 473/581
4,252,325 A * 2/1981 Weems ..... F42B 12/362 473/581
4,277,069 A * 7/1981 Rouse ..... F42B 12/362 473/581
4,380,340 A * 4/1983 Simo ..... F42B 6/04 473/577
5,273,293 A * 12/1993 Lekavich ..... F42B 6/04 138/173
5,516,117 A 5/1996 Rangel
6,238,310 B1 * 5/2001 Morrison ..... F42B 6/04 473/581
6,554,726 B2 4/2003 Thurber
6,595,880 B2 * 7/2003 Becker ..... F42B 6/04 124/44.5
6,719,652 B1 * 4/2004 Rhodes, Jr. ..... F42B 6/04 473/581
8,784,242 B2 * 7/2014 Gendregske ..... F42B 6/04 473/578
9,194,670 B2 * 11/2015 Gendregske ..... F42B 12/362
9,933,238 B1 * 4/2018 Campbell ..... F42B 6/04
2002/0183143 A1 * 12/2002 Kane ..... F42B 6/04 473/581

(Continued)

*Primary Examiner* — Alexander R Niconovich

(57) ABSTRACT

A blood draining arrow for increasing lethality and enhancing a blood trail includes a shaft, an arrowhead, a fletching, and a nock. The arrowhead and the nock are coupled to and extend from a first end and a second end of the shaft, respectively. The fletching is coupled to and extends radially from the shaft proximate to the second end. A channel extends axially through the shaft from proximate to the first end to proximate to the second end. Each of a plurality of holes is positioned in the shaft and extends to the channel. Holes in a first section of the shaft that is inserted into flesh of an animal are configured for blood to enter. The blood flows through the channel to drain from holes that are positioned in a second section of the shaft to prevent clotting of the blood and to enhance a blood trail.

8 Claims, 3 Drawing Sheets

(56) References Cited

U.S. PATENT DOCUMENTS

| | | | | |
|---|---|---|---|---|
| 2007/0225093 | A1* | 9/2007 | Kidwell | F42B 6/04 473/578 |
| 2012/0157247 | A1* | 6/2012 | Asherman | F42B 6/04 473/578 |

* cited by examiner

BLOOD DRAINING ARROW

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to arrows and more particularly pertains to a new arrow for increasing lethality and enhancing a blood trail.

BRIEF SUMMARY OF THE INVENTION

An embodiment of the disclosure meets the needs presented above by generally comprising a shaft, an arrowhead, a fletching, and a nock. The arrowhead and the nock are coupled to and extend from a first end and a second end of the shaft, respectively. The fletching is coupled to and extends radially from the shaft proximate to the second end. A channel extends axially through the shaft from proximate to the first end to proximate to the second end. Each of a plurality of holes is positioned in the shaft and extends to the channel. Holes in a first section of the shaft that is inserted into flesh of an animal are configured for blood to enter. The blood flows through the channel to drain from holes that are positioned in a second section of the shaft to prevent clotting of the blood and to enhance a blood trail.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

Figure 1:
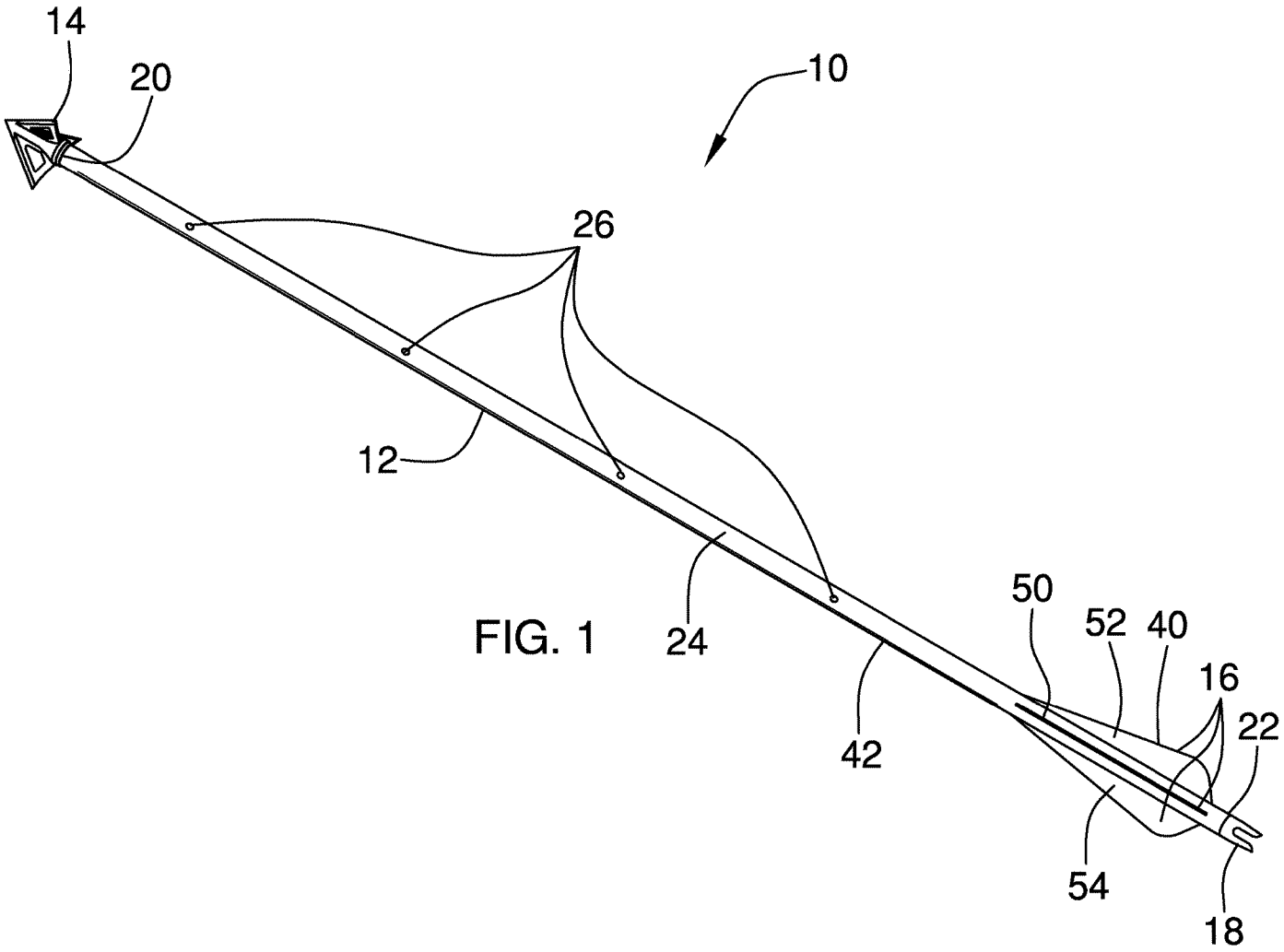
FIG. 1 is an isometric perspective view of a blood draining arrow according to an embodiment of the disclosure.
Figure 2:
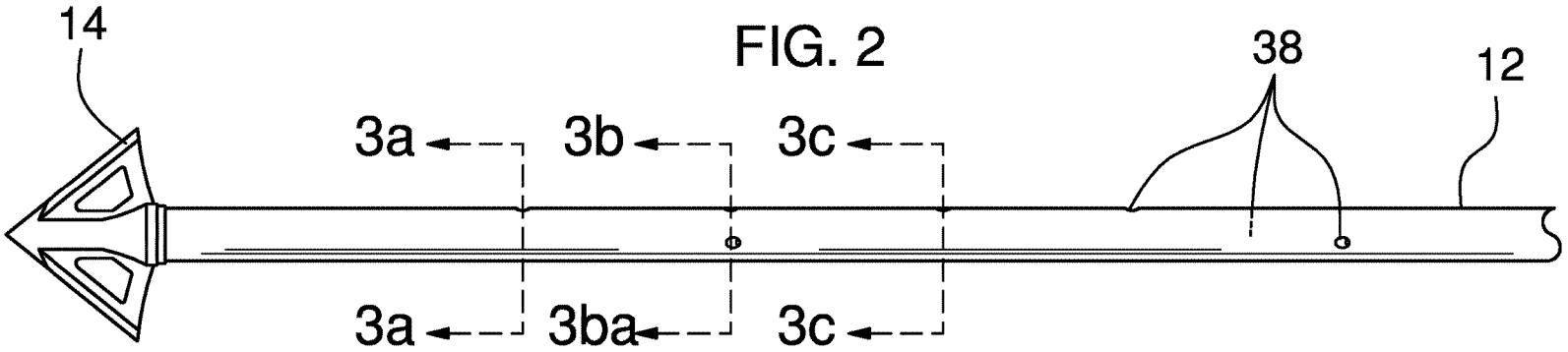
FIG. 2 is a side view of an embodiment of the disclosure.
Figure 3C:
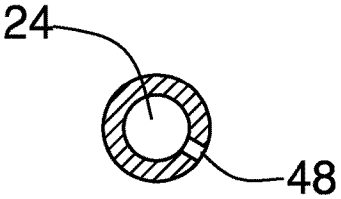
Figure 3B:
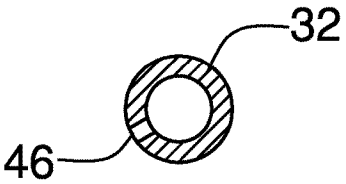
Figure 3A:
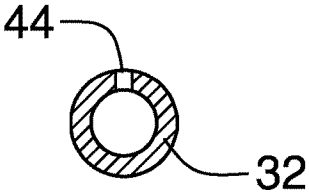

FIG. 3*a*-3*b* are cross-sectional views of an embodiment of the disclosure.

Figure 4:
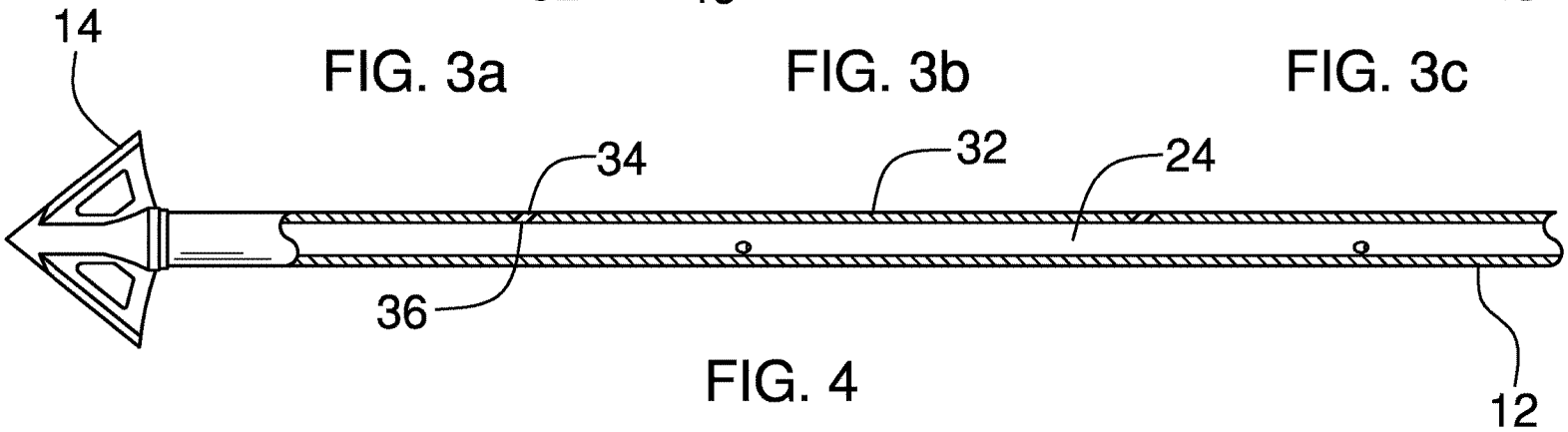

FIG. 4 is a cross-sectional view of an embodiment of the disclosure.

Figure 5:
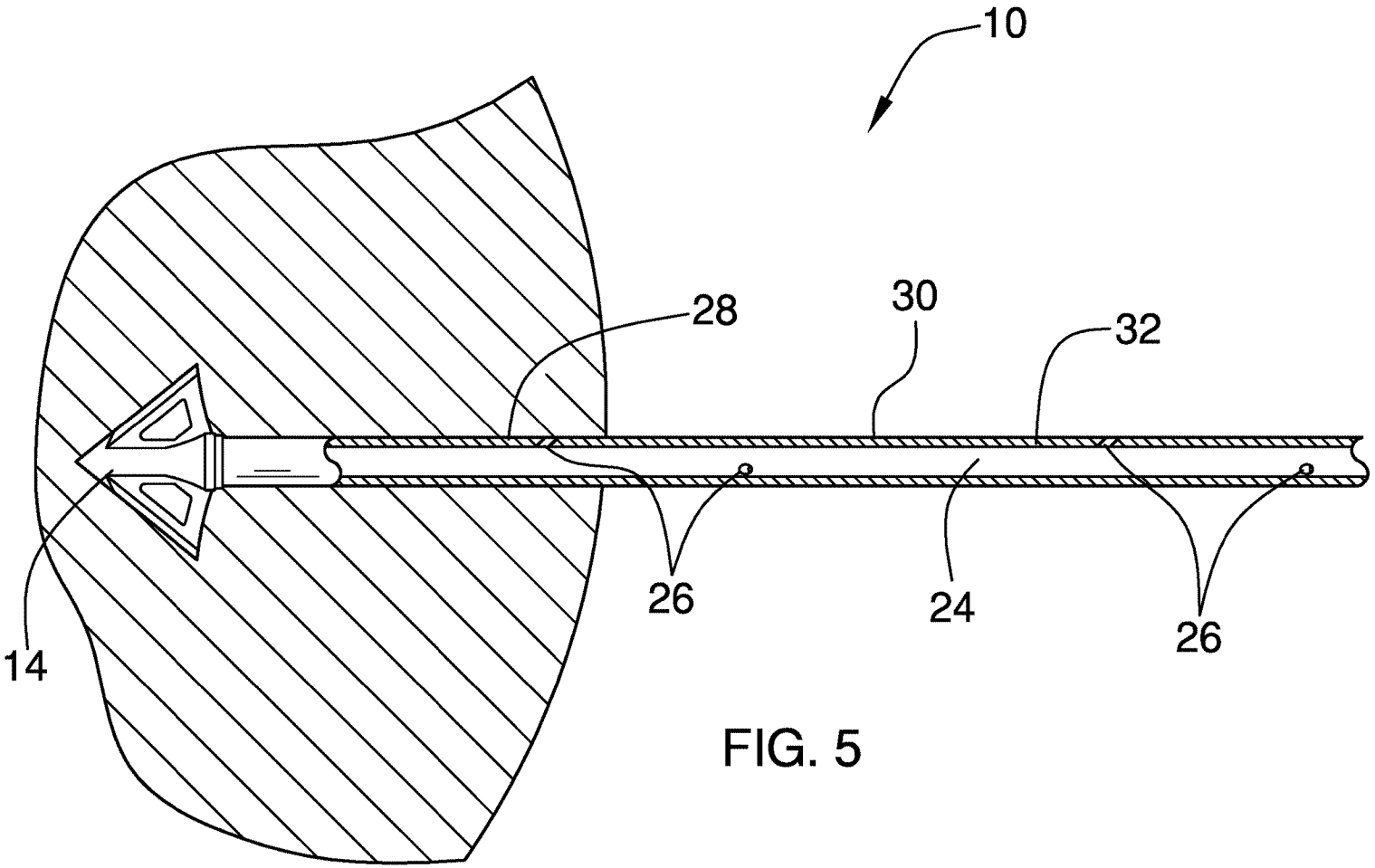

FIG. 5 is an in-use view of an embodiment of the disclosure.

DETAILED DESCRIPTION OF THE INVENTION

With reference now to the drawings, and in particular to FIGS. 1 through 5 thereof, a new arrow embodying the principles and concepts of an embodiment of the disclosure and generally designated by the reference numeral 10 will be described.

As best illustrated in FIGS. 1 through 5, the blood draining arrow 10 generally comprises a shaft 12, an arrowhead 14, a fletching 16, and a nock 18. The arrowhead 14 and the nock 18 are coupled to and extend from a first end 20 and a second end 22 of the shaft 12, respectively. The fletching 16 is coupled to and extends radially from the shaft 12 proximate to the second end 22.

A channel 24 extends axially through the shaft 12 from proximate to a first end 20 to proximate to a second end 22 of the shaft 12. A plurality of holes 26 is positioned in the shaft 12. Each hole 26 extends to the channel 24. The plurality of hole 26 extends from proximate to the first end 20 to proximate to the second end 22 of the shaft 12.

Respective holes 26 that are positioned in a first section 28 of the shaft 12 that is inserted into flesh of an animal are configured for blood to enter from the flesh, as shown in FIG. 5. The blood flows through the channel 24 to drain from respective holes 26 that are positioned in a second section 30 of the shaft 12 to prevent clotting of the blood and to enhance a blood trail. The increased loss of blood increases the lethality of the arrow 38, providing for an increased kill rate. The enhanced blood trail increases the likelihood of recovering game. In an event where the shaft 12 is broken, the blood would continue to flow through the channel 24.

Each hole 26 extends transversely through a wall 32 of the shaft 12 so that an outer perimeter 34 of the hole 26 is closer to the second end 22 of the shaft 12 than an inner perimeter 36 of the hole 26, as shown in FIG. 4. The hole 26 extends through the wall 32 at forty-five degrees. The angular positioning of the holes 26 in the wall 32 of the shaft 12 provides several benefits, including reducing the likelihood of the holes 26 becoming clogged as the shaft 12 enters the flesh, limiting noise produced by the arrow 10 in flight, and reducing drag on the arrow 10.

The plurality of holes 26 is positioned in a set of three rows 38. The rows 38 extend in parallel from proximate to the first end 20 to proximate to the second end 22 of the shaft 12. Each row 38 comprises from three to six holes 26, with the number of holes 26 being determined by a length 40 of the shaft 12.

Each row 38 comprises four holes 26. Each row 38 is aligned with a respective fletch 42 of the fletching 16. The holes 26 of each row 38 are equivalently spaced from adjacent holes 26 of the row 38. Each row 38 has a respective position between the first end 20 and the second end 22 of the shaft 12 so that the plurality of holes 26 extends spirally around the shaft 12 from proximate to the first end 20 to proximate to the second end 22. The spiral positioning of the holes 26 around the shaft 12 complements a curvature of the fletching 16. To the extent the holes 26 interact with the air during flight, the effect would be a desirable increase in a rotational rate of the shaft 12 during flight of the arrow 10.

The plurality of rows 38 comprises a first line 44, a second line 46, and a third line 48. The first line 44 extends from proximate to a cock fletch 50 to proximate to the arrowhead 14. The first line 44 begins from 4.00 to 7.00 centimeters from the arrowhead 14. The first line 44 begins 5.40 centimeters from the arrowhead 14. The second line 46 extends from proximate to a first hen fletch 52 to proximate to the arrowhead 14. The second line 46 begins from 7.00 to 10.00 centimeters from the arrowhead 14. The second line 46 begins 8.57 centimeters from the arrowhead 14. The third line 48 extends from proximate to a second hen fletch 54 to proximate to the arrowhead 14. The third line 48 begins from 10.00 to 13.50 centimeters from the arrowhead 14. The third line 48 begins 11.75 centimeters from the arrowhead 14.

In use, the arrow 10 is launched from a bow to impact a target animal. The first section 28 of the shaft 12 penetrates the flesh of the target animal. Respective holes 26 that are positioned in the first section 28 of the shaft 12 are configured for blood to enter from the flesh. The blood flows through the channel 24 to drain from respective holes 26 that are positioned in the second section 30 of the shaft 12 to prevent clotting of the blood and to enhance the blood trail. In the event where the shaft 12 is broken, the blood continues to flow through the channel 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A blood draining arrow comprising:

a shaft;

a channel extending axially through the shaft from proximate to a first end to proximate to a second end of the shaft;

an arrowhead coupled to and extending from the first end of the shaft;

a fletching coupled to and extending radially from the shaft proximate to the second end of the shaft;

a nock coupled to and extending from the second end of the shaft; and a plurality of holes positioned in the shaft, each hole extending to the channel, the plurality of holes extending from proximate to the first end to proximate to the second end of the shaft wherein respective holes positioned in a first section of the shaft inserted into flesh of an animal are configured for entering of blood from the flesh such that the blood flows through the channel to drain from respective holes positioned in a second section of the shaft for preventing clotting of the blood and enhancing a blood trail, the plurality of holes being positioned only in a set of three rows, each of the three rows extending in parallel from proximate to the first end to proximate to the second end of the shaft, each row aligning with a respective fletch of the fletching, the holes of each row being equivalently space from adjacent holes of the row, said holes of each of said rows being offset relative to each other along a length of said shaft between the first end and the second end of the shaft such that the plurality of holes extends spirally around the shaft from proximate to the first end to proximate to the second end and each hole of said plurality of holes is positioned singly within a respective plane perpendicular to a longitudinal axis of said shaft.

2. The arrow of claim 1, further including each hole extending transversely through a wall of the shaft such that an outer perimeter of the hole is closer to the second end of the shaft than an inner perimeter of the hole.

3. The arrow of claim 2, further including the hole extending through the wall at forty-five degrees.

4. The arrow of claim 1, further including each row comprising from three to six holes.

5. The arrow of claim 4, further including each row comprising four holes.

6. The arrow of claim 1, further including the plurality of rows comprising:

a first line extending from proximate to a cock fletch to proximate to the arrowhead, the first line beginning from 4.00 to 7.00 centimeters from the arrowhead;

a second line extending from proximate to a first hen fletch to proximate to the arrowhead, the second line beginning from 7.00 to 10.00 centimeters from the arrowhead; and a third line extending from proximate to a second hen fletch to proximate to the arrowhead, the third line beginning from 10.00 to 13.50 centimeters from the arrowhead.

7. The arrow of claim 6, further comprising:

the first line beginning 5.40 centimeters from the arrowhead;

the second line beginning 8.57 centimeters from the arrowhead; and the third line beginning 11.75 centimeters from the arrowhead.

8. A blood draining arrow comprising:

a shaft;

a channel extending axially through the shaft from proximate to a first end to proximate to a second end of the shaft;

an arrowhead coupled to and extending from the first end of the shaft;

a fletching coupled to and extending radially from the shaft proximate to the second end of the shaft;

a nock coupled to and extending from the second end of the shaft; and a plurality of holes positioned in the shaft, each hole extending to the channel, the plurality of holes extending from proximate to the first end to proximate to the second end of the shaft wherein respective holes positioned in a first section of the shaft inserted into flesh of an animal are configured for entering of blood from the flesh such that the blood flows through the channel to drain from respective holes positioned in a second section of the shaft for preventing clotting of the blood and enhancing a blood trail, each hole extending transversely through a wall of the shaft such that an outer perimeter of the hole is closer to the second end of the shaft than an inner perimeter of the hole, the hole extending through the wall at forty-five degrees, the plurality of holes being positioned only in a set of three rows, the rows extending in parallel from proximate to the first end to proximate to the second end of the shaft, each row comprising four holes, each row aligning with a respective fletch of the fletching, the holes of each row being equivalently space from adjacent holes of the row, the holes of each of the rows being offset relative to each other along a length of said the between the first end and the second end of the shaft such that the plurality of holes extends spirally around the shaft from proximate to the first end to proximate to the second end and each hole of the plurality of holes is positioned singly within a respective plane perpendicular to a longitudinal axis of the shaft, the plurality of rows comprising:

a first line extending from proximate to a cock fletch to proximate to the arrowhead, the first line beginning from 4.00 to 7.00 centimeters from the arrowhead, the first line beginning 5.40 centimeters from the arrowhead, a second line extending from proximate to a first hen fletch to proximate to the arrowhead, the second line beginning from 7.00 to 10.00 centimeters from the arrowhead, the second line beginning 8.57 centimeters from the arrowhead, and a third line extending from proximate to a second hen fletch to proximate to the arrowhead, the third line beginning from 10.00 to 13.50 centimeters from the arrowhead, the third line beginning 11.75 centimeters from the arrowhead.

* * * * *